US009221089B2

(12) United States Patent
Lee et al.

(10) Patent No.: US 9,221,089 B2
(45) Date of Patent: Dec. 29, 2015

(54) CLAMPING DEVICE FOR BENDING PRESS AND BENDING PRESS PROVIDED WITH THE SAME

(71) Applicant: SUNGWOO HITECH CO., LTD., Busan (KR)

(72) Inventors: Mun Yong Lee, Busan (KR); Sang Jin Ha, Busan (KR)

(73) Assignee: SUNGWOO HITECH CO., LTD., Busan (KR)

( * ) Notice: Subject to any disclaimer, the term of this patent is extended or adjusted under 35 U.S.C. 154(b) by 328 days.

(21) Appl. No.: 13/726,323

(22) Filed: Dec. 24, 2012

(65) Prior Publication Data

US 2014/0165687 A1 Jun. 19, 2014

(30) Foreign Application Priority Data

Dec. 13, 2012 (KR) ..... 10-2012-0145701

(51) Int. Cl.

| | |
|---|---|
| ***B21D 7/00*** | (2006.01) |
| ***B21D 9/07*** | (2006.01) |
| ***B21D 22/02*** | (2006.01) |
| ***B21D 25/04*** | (2006.01) |

(52) U.S. Cl.

CPC *B21D 7/00* (2013.01); *B21D 9/076* (2013.01); *B21D 22/025* (2013.01); *B21D 25/04* (2013.01)

(58) Field of Classification Search

CPC ..... B21D 7/04; B21D 7/16; B21D 7/02; B21D 11/02; B21D 7/00; B21D 22/025; B21D 9/076; B21D 25/04

USPC ..... 72/304–306, 308, 309, 310, 311, 314, 72/315, 320, 321, 322, 302, 316, 319, 323, 72/482.1–482.5, 296–300

See application file for complete search history.

(56) References Cited

U.S. PATENT DOCUMENTS

| | | | | | |
|---|---|---|---|---|---|
| 2,431,173 | A | * | 11/1947 | Hawkes | 72/297 |
| 2,850,071 | A | * | 9/1958 | Kraybill | 72/297 |
| 3,065,781 | A | * | 11/1962 | Muller | 72/31.01 |
| 3,082,809 | A | * | 3/1963 | Petsch et al. | 72/31.01 |
| 3,440,856 | A | * | 4/1969 | Hoffmann et al. | 72/302 |
| 3,525,247 | A | * | 8/1970 | Demetriades et al. | 72/305 |
| 3,540,257 | A | * | 11/1970 | Hertl | 72/302 |

(Continued)

FOREIGN PATENT DOCUMENTS

| | | |
|---|---|---|
| JP | 62-118919 | 5/1987 |
| JP | 06-142805 | 5/1994 |

(Continued)

*Primary Examiner* — Shelley Self
*Assistant Examiner* — Gregory Swiatocha
(74) *Attorney, Agent, or Firm* — Lex IP Meister, PLLC

(57) ABSTRACT

A clamping device for a bending press includes a clamping die with a space formed therein, a clamping holder rotatably disposed within the space of the clamping die around a rotation shaft formed thereto, an upper cam block and a lower cam block respectively disposed within the clamping holder and slidable along the horizontal direction, and of which a cam slant surface is formed at a front side of the upper cam block and the lower cam block respectively, an upper clamping block and a lower clamping block contacting each cam slant surface of the upper cam block and the lower cam block, and clamping an end of a pipe disposed therebetween by sliding along a slant direction of the clamping holder, and a pressing unit selectively pressing the upper cam block and the lower cam block.

19 Claims, 12 Drawing Sheets

(56) References Cited

U.S. PATENT DOCUMENTS

| | | | | | |
|---|---|---|---|---|---|
| 3,550,420 | A | * | 12/1970 | Swanson | 72/296 |
| 4,453,394 | A | * | 6/1984 | Just | 72/302 |
| 4,827,753 | A | * | 5/1989 | Moroney | 72/296 |
| 5,502,997 | A | * | 4/1996 | Boettger et al. | 72/466 |
| 5,771,730 | A | * | 6/1998 | Huet | 72/58 |

FOREIGN PATENT DOCUMENTS

| | | |
|---|---|---|
| JP | 4603194 | 12/2010 |
| KR | 1020110050996 | 5/2011 |
| KR | 10-2012-0023884 | 3/2012 |
| KR | 10-2012-0094621 | 8/2012 |

* cited by examiner

CLAMPING DEVICE FOR BENDING PRESS AND BENDING PRESS PROVIDED WITH THE SAME

CROSS-REFERENCE TO RELATED APPLICATION

This application claims priority to and the benefit of Korean Patent Application No. 10-2012-0145701 filed in the Korean Intellectual Property Office on Dec. 13, 2012, the entire contents of which are incorporated herein by reference.

BACKGROUND OF THE INVENTION (a) Field of the Invention

The present invention relates to a clamping device for a bending press and a bending press system provided with the same. More particularly, the present invention relates to a clamping device for a bending press and a bending press system provided with the same that is adapted to form a pipe to have a predetermined curvature in a state that both ends of the pipe manufactured through extrusion are clamped.

(b) Description of the Related Art

Generally, a bending device is used for manufacturing a beam and the like with a predetermined curvature. Particularly, the bending device presses a roll forming beam such as a bumper beam for a vehicle, or a straight tube such as an extruded tube to have a predetermined curvature.

The bending device may be a roll bending device, a round bending device, a stretching device, and so on.

According to roll bend forming, if a metal pipe is supplied to a plurality of bending rolls that are disposed along a predetermined curvature and are rotated, the metal pipe is formed to have a predetermined curvature when passing through the plurality of bending rolls.

According to round bending, if a metal pipe passes through a plurality of forming rolls, the metal pipe is formed to have a predetermined curvature when passing through the plurality of forming rolls.

According to stretch bend forming, after both ends of the metal pipe are fixed and a middle portion of the metal pipe is contacted to a die having a predetermined curvature, a force toward the die is applied to both ends of the metal pipe so as to bend the metal pipe to have a predetermined curvature.

However, according to the roll bending forming, a high degree of precision may not be expected, and it is difficult to form the curvature to aluminum extruded tube or pipe, or a steel tube or pipe with high strength.

Also, the round bending or the stretch bend forming requires a huge initial investment for facilities and productivity is not efficient.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a clamping device for a bending press and a bending press system provided with the same that is adapted to form a pipe to have a predetermined curvature and simultaneously stretch the pipe.

A clamping device for a bending press according to an exemplary embodiment of the present invention may include a clamping die with a space formed therein, a clamping holder rotatably disposed within the space of the clamping die around a rotation shaft formed thereto, an upper cam block and a lower cam block respectively disposed within the clamping holder and slidable along the horizontal direction, and of which a cam slant surface is formed at a front side of the upper cam block and the lower cam block, respectively, an upper clamping block and a lower clamping block contacting each cam slant surface of the upper cam block and the lower cam block, and clamping an end of a pipe disposed therebetween by sliding along a slant direction of the clamping holder, and a pressing unit selectively pressing the upper cam block and the lower cam block.

A slip slant surface may be slantedly formed to the clamping block for contacting and sliding the cam slant surface.

The clamping device may further include a core member which is slidably disposed between the upper clamping block and the lower clamping block and selectively inserted into the pipe by pressing of the pressing unit.

The clamping holder may include a first guide portion guiding each of the upper cam block and the lower cam block along the horizontal direction, a second guide portion guiding the upper clamping block and the lower clamping block to move the upper clamping block and the lower clamping block close to each other, and a third guide portion formed between the first guide portions and guiding the core member along the horizontal direction.

A core rod may be integrally formed to the core member and connected to the pressing unit.

A cam rod may be integrally formed to the cam block and protruded toward the pressing unit.

The pressing unit may include a pressing plate which is movably disposed on a plurality of guide bars fixed to the clamping holder and selectively pushes the cam block and the core member, and a clamping cylinder which pushes the pressing plate though an operating rod for the pressing plate to be moved.

The clamping device may further include a fixing plate fixed to the guide bar, wherein the operating rod of the clamping cylinder may be connected to the pressing plate through the fixing plate.

A plurality of fixing rods may be mounted to the fixing plate in the opposite direction of the guide bar, a supporting plate may be mounted to the fixing rod, and the clamping cylinder may be mounted to the supporting plate.

A mounting plate may be mounted to the supporting plate, and a stretch cylinder, which selectively pushes the clamping die, may be mounted to the mounting plate.

A slot into which the rotation shaft is inserted may be formed to the clamping die, and the clamping holder may move along the slot by pressing of the stretch cylinder.

A clamping protrusion may be formed to an end portion of the clamping block for the pipe to be clamped thereto.

A scratched surface may be formed to an end portion of the clamping block for the pipe to be clamped thereto.

A bending press system according to an exemplary embodiment of the present invention may include a lower die which is disposed on a base through a cushion pin, is movable up and down through the cushion pin, and a curvature forming surface for a pipe to be disposed thereto is formed thereto, an upper die disposed above the base and movable up and down, a clamping die fixed on the base and of which a space formed therewithin, a clamping holder rotatably disposed within the space of the clamping die around a rotation shaft formed thereto, an upper cam block and a lower cam block respectively disposed within the clamping holder and slidable along the horizontal direction, and of which a cam slant surface is formed at a front side of the upper cam block and the lower cam block respectively, an upper clamping block and a lower clamping block, of which a slip slant surface is slantedly formed thereto for contacting and sliding the cam slant surface of the upper cam block and the lower cam block, and clamping an end of the pipe disposed therebetween by sliding along a slant direction of the clamping holder, and a pressing unit selectively pressing the upper cam block and the lower cam block.

The clamping device may further include a core member which is slidably disposed between the upper clamping block and the lower clamping block and selectively inserted into the pipe by pressing of the pressing unit.

The clamping holder may include a first guide portion guiding each of the upper cam block and the lower cam block along the horizontal direction, a second guide portion guiding the upper clamping block and the lower clamping block to move the upper clamping block and the lower clamping block close to each other, and a third guide portion formed between the first guide portions and guiding the core member along the horizontal direction.

The pressing unit may include a pressing plate which is movably disposed on a plurality of guide bars fixed to the clamping holder, and selectively pushes the cam block and the core member, and a clamping cylinder which pushes the pressing plate though an operating rod for the pressing plate to be moved.

The clamping device may further include a fixing plate fixed to the guide bar, wherein the operating rod of the clamping cylinder may be connected to the pressing plate through the fixing plate, a plurality of fixing rods may be mounted to the fixing plate in the opposite direction of the guide bar, a supporting plate may be mounted to the fixing rod, and the clamping cylinder may be mounted to the supporting plate.

A mounting plate may be mounted to the supporting plate, a stretch cylinder, which selectively pushes the clamping die, may be mounted to the mounting plate, a slot into which the rotation shaft is inserted may be formed to the clamping die, and the clamping holder may move along the slot by pressing of the stretch cylinder.

A support cylinder may be hingedly connected with the base and the mounting plate for supporting rotation of the clamping holder.

According to an exemplary embodiment of the present invention, a pipe may be formed to have a predetermined curvature in a state in which both ends of the pipe manufactured through extrusion are clamped.

According to an exemplary embodiment of the present invention, since a stretching process may be realized after bending end portions of a pipe so as to induce a pipe to be formed plastically, spring-back may be prevented.

In addition, according to an exemplary embodiment of the present invention, a relatively low investment is required, a manufacturing cycle may be reduced, and productivity may be improved.

BRIEF DESCRIPTION OF THE DRAWINGS

The above and other objects, features, and advantages of the present invention will be more apparent from the following detailed description in conjunction with the accompanying drawings, in which.

<Description of Symbols>

Figure 1:
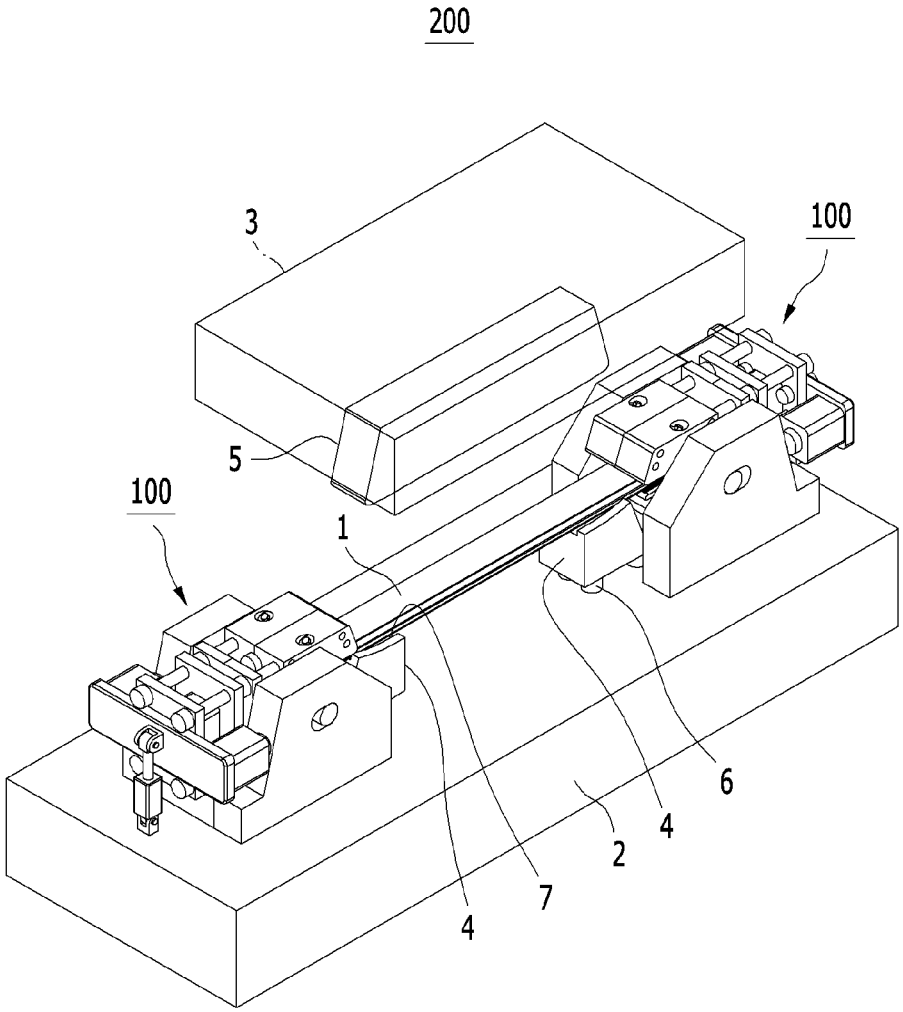
FIG. 1 is a perspective view of a bending press system to which a clamping device for a bending press according to an exemplary embodiment of the present invention is applied.

| | |
|---|---|
| 1: pipe | 2: base |
| 3: slider | 4: lower die |
| 5: upper die | 6: cushion pin |
| 7: curvature forming surface | 20: clamping die |
| 21: space | 23: die main body |
| 25: slot | 30: clamping holder |
| 31: holder block | 32: rotation shaft |
| 33: first guide portion | 33a: first guide surface |
| 33b: protrusion | 34: second guide portion |
| 34a: first slant surface | 34b: second slant surface |
| 34c: third slant surface | 36: third guide portion |
| 37: guide rail | 39: guide hole |
| 40: cam block | 41: cam slant surface |
| 47: cam rod | 50: clamping block |
| 51: slip slant surface | 52: clamping surface |
| 53: clamping protrusion | 60: core member |
| 61: core rod | 70: pressing unit |
| 71: pressing plate | 73: clamping cylinder |
| 75, 91: operating rod | 76: guide bar |
| 81: fixing plate | 83: fixing rod |
| 85: supporting plate | 87: mounting plate |
| 90: stretch cylinder | 95: support cylinder |
| 97: cylinder rod | |

DETAILED DESCRIPTION OF THE EMBODIMENTS

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

Further, in the drawings, a size and thickness of each element are randomly represented for better understanding and ease of description and the present invention is not limited thereto, and the thickness of layers, films, panels, regions, etc., are exaggerated for clarity.

In the following detailed description, in order to distinguish constituent elements of the same name, the constituent elements have names of a first, a second, and a third, and the first, the second, and the third are not limited to order thereof.

In the specification, unless explicitly described to the contrary, the word "comprise" and variations such as "comprises" or "comprising" will be understood to imply the inclusion of stated elements but not the exclusion of any other elements.

In the specification, terms such as "portion" and "means" mean a unit of a comprehensive element having at least one function or movement.

FIG. 1 is a perspective view of a bending press system to which a clamping device for a bending press according to an exemplary embodiment of the present invention is applied.

Referring to FIG. 1, a clamping device 100 for a bending press according to an exemplary embodiment of the present invention may be applied to a bending press system 200 which forms curvature to end portions of a pipe 1 using an upper die and a lower die to press the pipe 1.

For example, the bending press system 200 basically includes a base 2, a slider 3, a lower die 4, an upper die 5, and the clamping device 100 according to an exemplary embodiment of the present invention.

The base 2 is mounted on a floor of a workroom. The slider 3 is movable upwardly and downwardly above the base 2. The lower die 4 and the upper die 5 are disposed to the base 2 and the slider 3 respectively and are adapted to bend an object supplied between the lower die 4 and the upper die 5 to have a predetermined curvature.

The lower die 4 is movable upward and downward on the base 2 through a cushion pin 6. A curvature forming surface 7 to bend the pipe supplied thereto to have a predetermined curvature is formed on the upper portion of the lower die 4.

The upper die 5 is mounted to a lower portion of the slider 3, and is moved by operations of the slider 3 and presses the end portions of the pipe 1 on the curvature forming surface 7 of the lower die 4.

The clamping device 100 according to an exemplary embodiment of the present invention is disposed on the base 2 corresponding to the lower die 4 and is adapted to clamp the end portions of the pipe 1 which will be bent.

The clamping device 100 clamps the end portions of the pipe 1 and is rotatable to allow the pipe 1 to be bent at a predetermined angle when the lower die 4 and the upper die 5 press the pipe 1.

The clamping device 100 may stretch the end portion of the pipe 1 as well as bend the end portion of the pipe 1.

Figure 2:
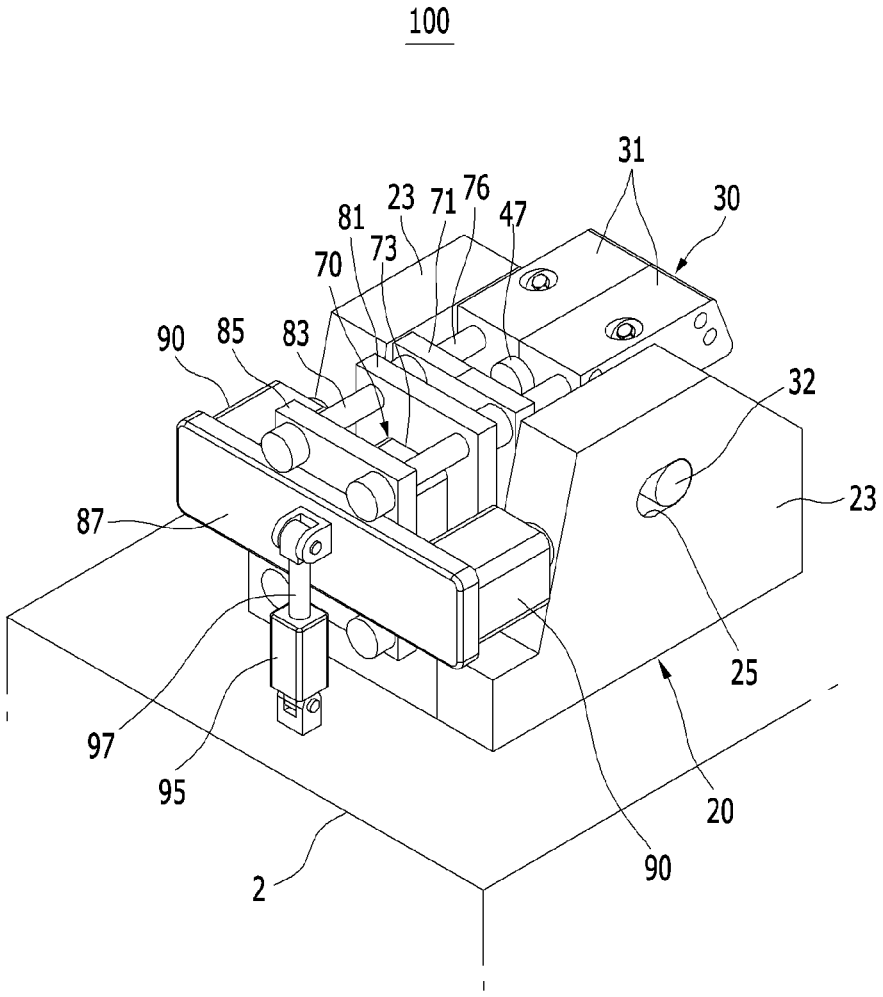
FIG. 2 and FIG. 3 are perspective views showing a clamping device for a bending press according to an exemplary embodiment of the present invention.
Figure 3:
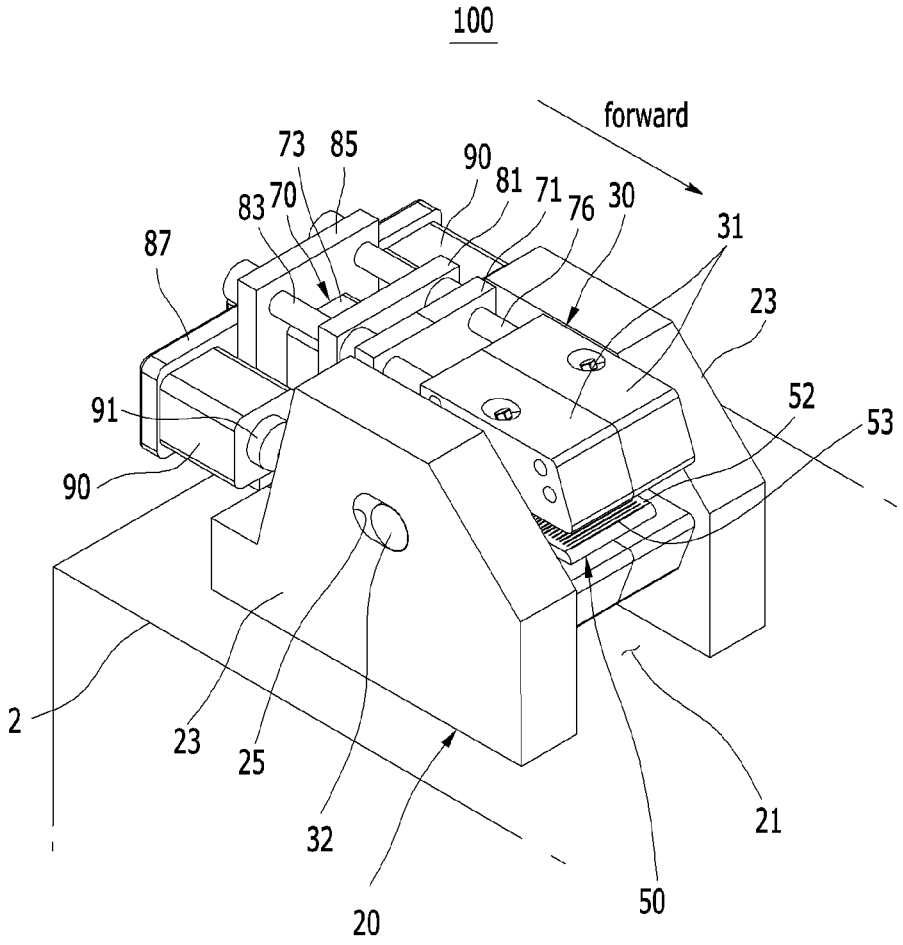
Figure 4:
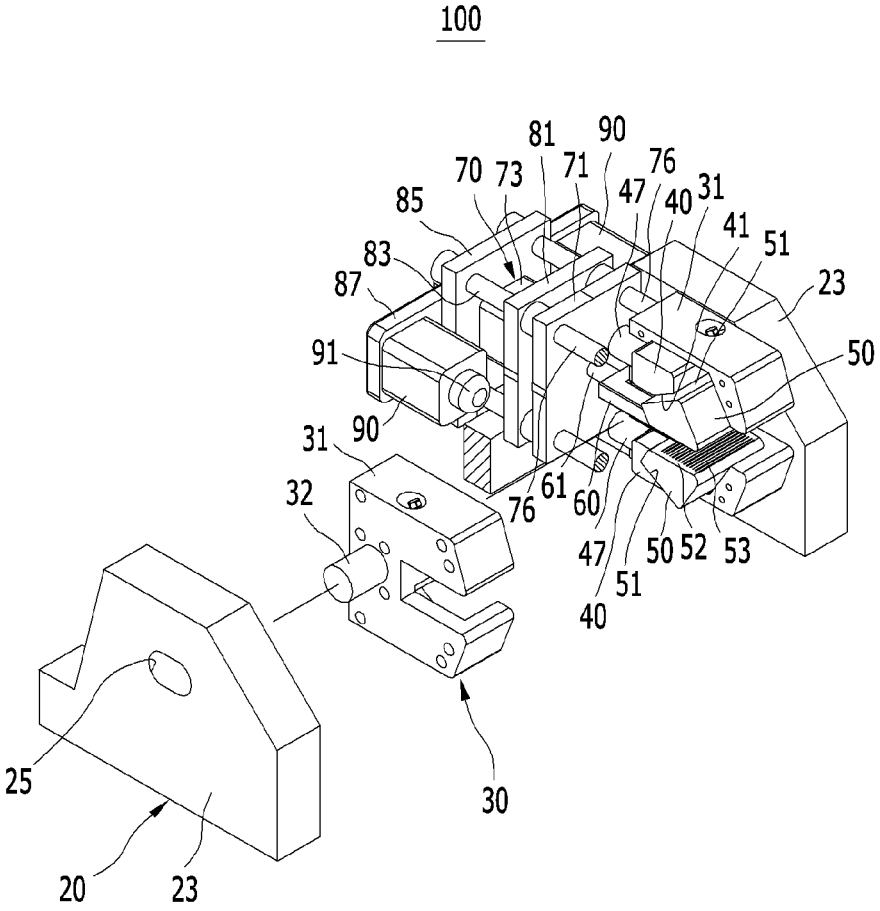
FIG. 4 and FIG. 5 are exploded perspective views showing a clamping device for a bending press according to an exemplary embodiment of the present invention.
Figure 5:
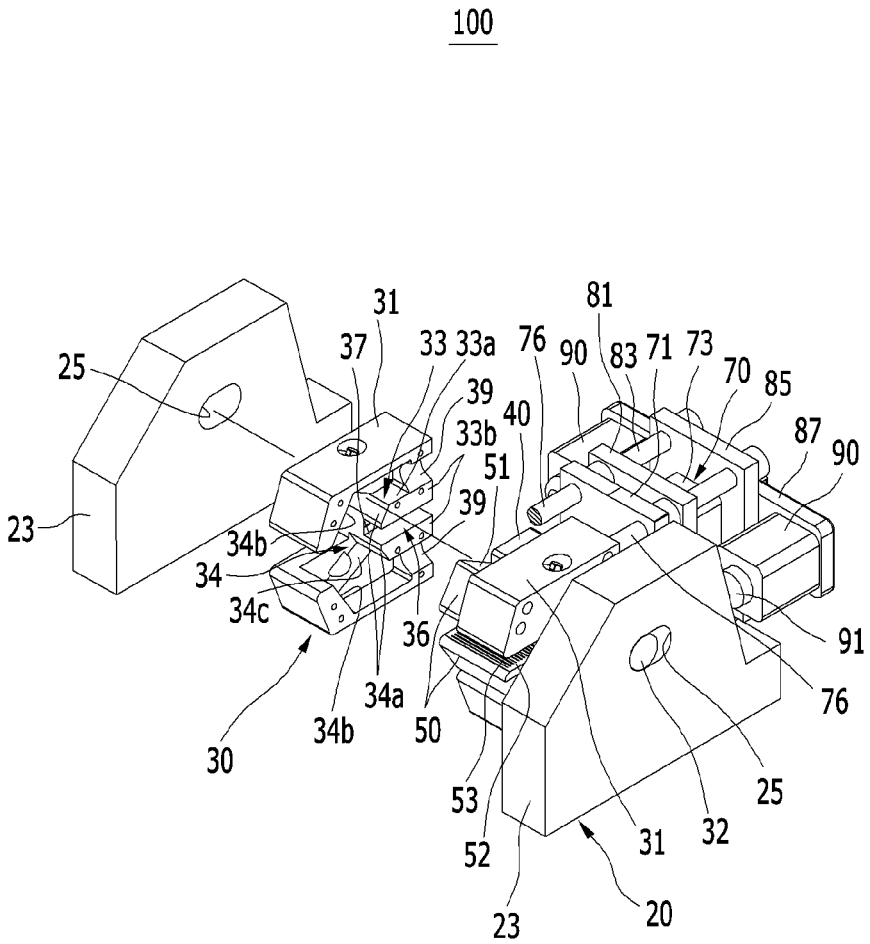

FIG. 2 and FIG. 3 are perspective views showing a clamping device for a bending press according to an exemplary embodiment of the present invention, and FIG. 4 and FIG. 5 are exploded perspective views showing a clamping device for a bending press according to an exemplary embodiment of the present invention.

Referring to FIG. 2 and FIG. 3, the clamping device 100 basically includes a clamping die 20, a clamping holder 30, a cam block 40, a clamping block 50, a core member 60, and a pressing unit 70.

A detailed description of the cam block 40, the clamping block 50, and the core member 60 will be discussed mainly referring to FIG. 4 and FIG. 5.

The clamping die 20 is fixed to the base 2, and a space 21 is formed within the clamping die 20. That is, the clamping die 20 includes a pair of die main bodies 23 disposed on the base 2 and the space 21 is formed therebetween.

The clamping holder 30 is rotatably disposed within the space 21 of the clamping die 20 around a rotation shaft 32 formed thereto. The clamping holder 30 is rotatable to allow the pipe 1 to be bent at a predetermined angle around the rotation shaft 32 when the lower die 4 and the upper die 5 press the pipe 1.

Referring to FIG. 4 and FIG. 5, the clamping holder 30 includes a pair of holder blocks 31 which are assembled or disassembled.

The rotation shaft 32 is fixed to each holder block 31 and the rotation shaft 32 is rotatably connected to the die main body 23 of the clamping die 20, respectively.

At each die main body 23, a slot 25 is formed for the rotation shaft 32 to be inserted therein. The slot 25 supports the rotation shaft 32 of the holder block 31 and guides movements of the clamping holder 30.

The holder block 31 is formed with a "C" shape, and a front side thereof is slantedly formed.

The cam block 40, the clamping block 50, and the core member 60 are adapted to support and clamp the end portions of the pipe on the lower die 4, referring to FIG. 1.

Within the clamping holder 30, the cam block 40 is slidably disposed along the horizontal direction at an upper portion and a lower portion of the clamping holder 30, respectively, which are assembled by a pair of holder blocks 31.

Hereinafter, the cam block 40 disposed at the upper portion of the clamping holder 30 will be denoted as "an upper cam block" and the cam block 40 disposed at the lower portion of the clamping holder 30 will be denoted as "a lower cam block".

The upper and lower cam blocks 40 are movable along the horizontal direction within the holder block 31. At a front side of each upper and lower cam blocks 40, cam slant surfaces 41 symmetrically inclined to each other are respectively formed.

That is, the cam slant surface 41 formed to the upper cam block 40 is formed from a lower portion to an upper portion of the cam block 40 toward the front, and the cam slant surface 41 formed to the lower cam block 40 is formed from an upper portion to a lower portion of the cam block 40 toward the front.

At the clamping holder 30, a first guide portion 33 is formed for the upper and lower cam blocks 40 to be moved along the horizontal direction. The first guide portion 33 is formed to each upper and lower portion within the holder block 31, respectively.

At the first guide portion 33, a first guide surface **33*a* is formed to guide the upper and lower cam blocks 40 along the horizontal direction. The first guide surface 33*a* may be formed by a pair of protrusions 33*b* for supporting a lower surface of the upper cam block 40 and an upper surface of the lower cam block 40**, respectively.

A cam rod 47 is integrally formed to each upper and the lower cam block 40 protruded rearward. The cam rod 47 is protruded toward the pressing unit 70.

A guide hole 39 is formed to the clamping holder 30, and the guide hole 39 is connected with the first guide portion 33 and the cam rod 47 is inserted therein.

The clamping block 50 is slidable along an inclined direction for clamping the end portions of the pipe 1 disposed on the lower die 4.

Hereinafter, the clamping block 50 disposed at an upper portion of the clamping holder 30 will be denoted as "an upper clamping block" and the clamping block 50 disposed at a lower portion of the clamping holder 30 will be denoted as "a lower clamping block"

Each upper and lower clamping block 50 is disposed within the holder block 31 along an inclined and a forward direction, respectively. At the upper and lower clamping blocks 50, a slip slant surface 51 slidably contacting the cam slant surface 41 of each upper and lower cam block 40 is formed, respectively.

That is, the slip slant surface 51 formed to the upper clamping block 50 is formed from a lower portion to an upper portion of the clamping block 50 toward the front, and the slip slant surface 51 formed to the lower clamping block 50 is formed from an upper portion to a lower portion of the clamping block 50 toward the front.

At each upper and lower clamping block 50, a clamping surface 52 for clamping the pipe 1 is formed, respectively.

A clamping protrusion 53 is formed to the clamping surface 52 or a scratched surface is formed to the clamping surface 52. However it is not limited thereto, and any structure for clamping the pipe 1 and preventing slipping of the pipe 1 may be applied to the clamping surface 52.

At the clamping holder 30, a second guide portion 34 is formed to guide the upper and lower clamping blocks 50 to be compressed by the upper and lower cam blocks 40.

The second guide portion 34 includes a first slant surface 34*a* which is connected with the first guide portion 33 at upper and lower portions of an inside surface of the holder block 31, a second slant surface 34*b* which is parallel to the first slant surface 34*a*, and a third slant surface 34*c* supporting sides of the upper and lower clamping blocks 50.

When the upper and lower cam blocks 40 push the upper and lower clamping blocks 50, the upper and lower clamping blocks 50 are guided by the first, second, and third slant surfaces 34*a*, 34*b*, and 34*c* so as to be close to each other, and then they clamp the end portions of the pipe 1 using the clamping surface 52.

The core member 60 is pushed by the pressing unit 70 and then inserted into the pipe 1, and thus the end portions of the pipe 1 may not be distorted when the upper and lower clamping blocks 50 clamp the pipe 1.

The core member 60 is slidable between the upper and lower clamping blocks 50 along the horizontal direction. The core member 60 is protruded toward the pressing unit 70.

A core rod 61 is integrally formed to the core member 60 and is connected to a pressing plate 71 of the pressing unit 70.

The core member 60 is slidably disposed within the first guide portion 33 of the clamping holder 30 along the horizontal direction. At the clamping holder 30, a third guide portion 36 for guiding the core member 60 along the horizontal direction is formed.

The third guide portion 36 includes a guide rail 37 formed between protrusions 33*b* of the second guide portion 33. Therefore, the core member 60 is slidable on the guide rail 37 along the horizontal direction.

The pressing unit 70 selectively pushes the upper and lower cam blocks 40 and the core member 60. The pressing unit 70 includes the pressing plate 71 and a clamping cylinder 73.

The pressing plate 71 is disposed to be movable along a plurality of guide bars 76 fixed to the clamping holder 30 for selectively pushing the cam rod 47 of the upper and lower cam blocks 40 and the core rod 61 of the core member 60.

The pressing plate 71 may be apart from the cam rod 47 of the upper and lower cam blocks 40 and connected to the core rod 61 of the core member 60.

Figure 6:
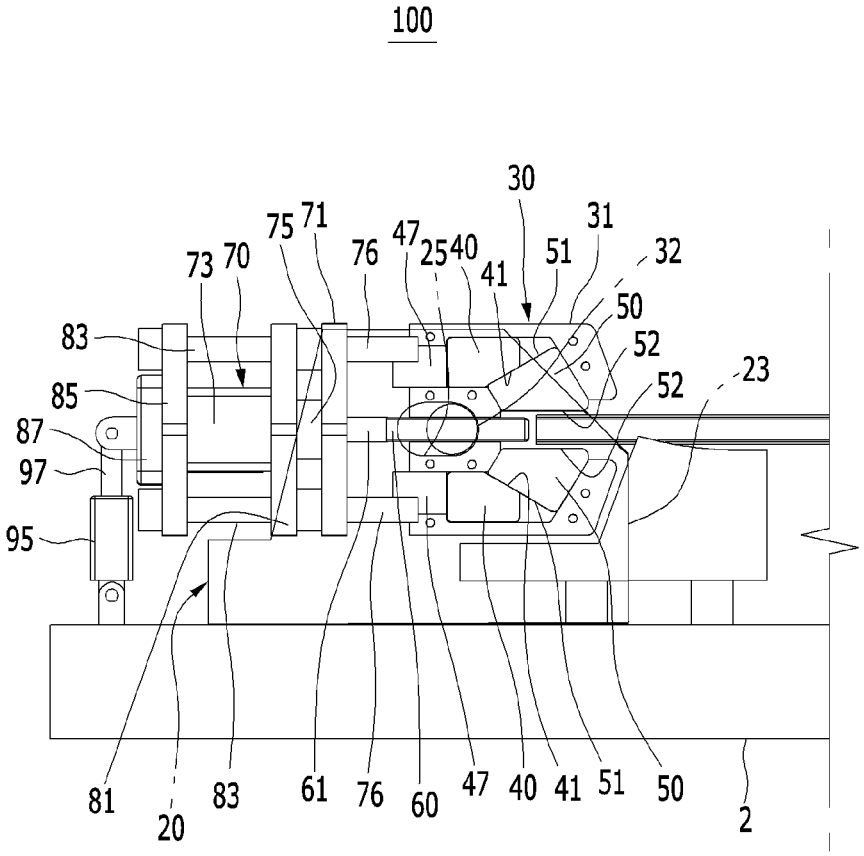
FIG. 6 is a partial opened-up view showing a bending press system according to an exemplary embodiment of the present invention.

The clamping cylinder 73 is connected with the pressing plate 71 through an operating rod 75, and as shown in FIG. 6, pushes the pressing plate 71 toward the clamping holder 30 through the operating rod 75.

The clamping cylinder 73 may be a hydraulic cylinder operated by hydraulic pressure, and selectively operates the operating rod 75 forward or rearward. The operating rod 75 of the clamping cylinder 73 is connected to the pressing plate 71 through a fixing plate 81 fixed to the guide bar 76.

At the fixing plate 81, a plurality of fixing rods 83 are mounted opposite to the guide bar 76, and a supporting plate 85 is mounted to the fixing rod 83.

The clamping cylinder 73 is mounted to the supporting plate 85. That is, the clamping cylinder 73 is fixed to the supporting plate 85 between the fixing plate 81 and the supporting plate 85. The operating rod 75 of the clamping cylinder 73 is connected to the pressing plate 71 through the fixing plate 81.

A mounting plate 87 is mounted to the supporting plate 85, and a stretch cylinder 90 for selectively pushing the die main body 23 of the clamping die 20 is mounted to the mounting plate 87.

At a state in which the upper and lower clamping blocks 50 clamp the pipe 1, the stretch cylinder 90 pushes the die main body 23 of the clamping die 20 using an operating rod 91. Therefore the clamping holder 30 moves in the outward direction of the pipe 1 with the supporting plate 85, the fixing rod 83, and so on.

That is, in a state in which the upper and lower clamping blocks 50 clamp the pipe 1 and the lower die 4 and the upper die 5 bend the pipe 1, the stretch cylinder 90 pushes the die main body 23 of the clamping die 20 so as to stretch the end portions of the pipe 1.

Since the operating rod 91 of the stretch cylinder 90 pushes the die main body 23 of the clamping die 20, the clamping holder 30 moves along the slot 25 of the die main body 23.

At the base 2, a support cylinder 95 for supporting rotation of the clamping holder 30 is equipped. One end of the support cylinder 95 is hingedly connected with the base 2, and the other end of the support cylinder 95 is hingedly connected with the mounting plate 87 through a cylinder rod 97.

The support cylinder 95 may be a gas lift cylinder or a spring cylinder. Further, a hydraulic cylinder operated by hydraulic pressure or a pneumatic cylinder operated by pneumatic pressure may be used.

In this case, the rotation of the clamping holder 30 means a rotation of a set including the clamping holder 30, the mounting plate 87, the guide bar 76, the fixing plate 81, the fixing rod 83, the supporting plate 85, and so on as constituent elements.

Hereinafter, operations of a bending press system according to an exemplary embodiment of the present invention will be discussed referring to FIG. 7 to FIG. 12.

FIG. 7 to FIG. 12 are drawings showing operations of a bending press system according to an exemplary embodiment of the present invention.

In this case, the bending press system 200 according to an exemplary embodiment of the present invention will be discussed for forming an extruded aluminum pipe 1 of a bumper beam with a predetermined curvature for easy comprehension. However, it will not be limited thereto.

Figure 7:
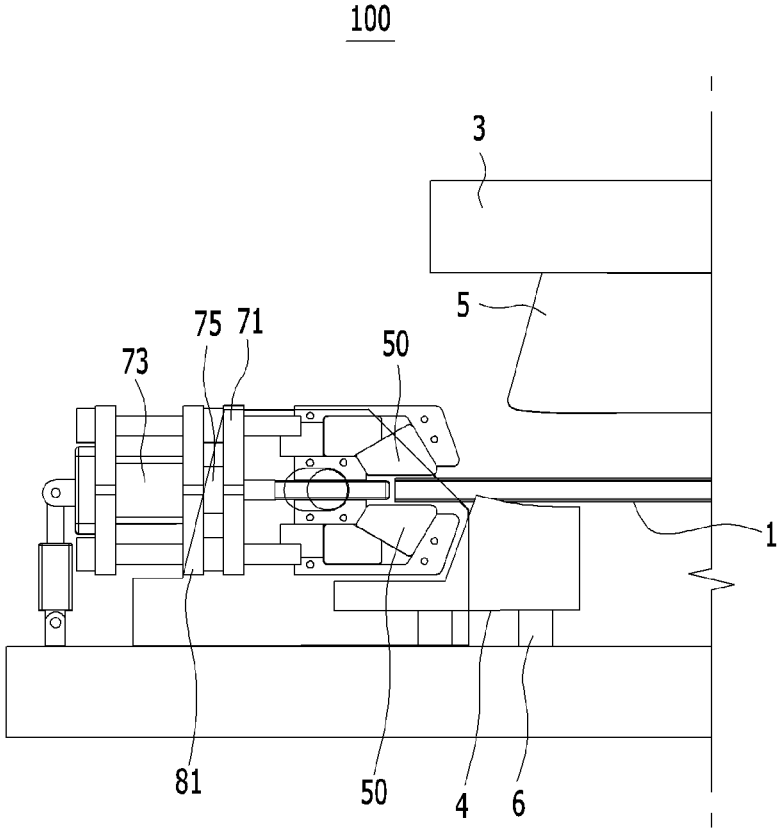
FIG. 7 to FIG. 12 are drawings showing operations of a bending press system according to an exemplary embodiment of the present invention.

Referring to FIG. 7, the upper die 5 moves upward by the operation of the slider 3, and the lower die 4 is supported by the cushion pin 6. Then the pipe 1 is supplied between the upper die 5 and the lower die 4.

In this state, the operating rod 75 of the clamping cylinder 73 is at a rearward position with the pressing plate 71, and thus the upper and lower clamping blocks 50 are apart from each other.

In this state, the end portions of the pipe 1 are positioned on the curvature forming surface 7 (referring to FIG. 1) of the lower die 4 and are then supplied between the upper and lower clamping blocks 50.

Figure 8:
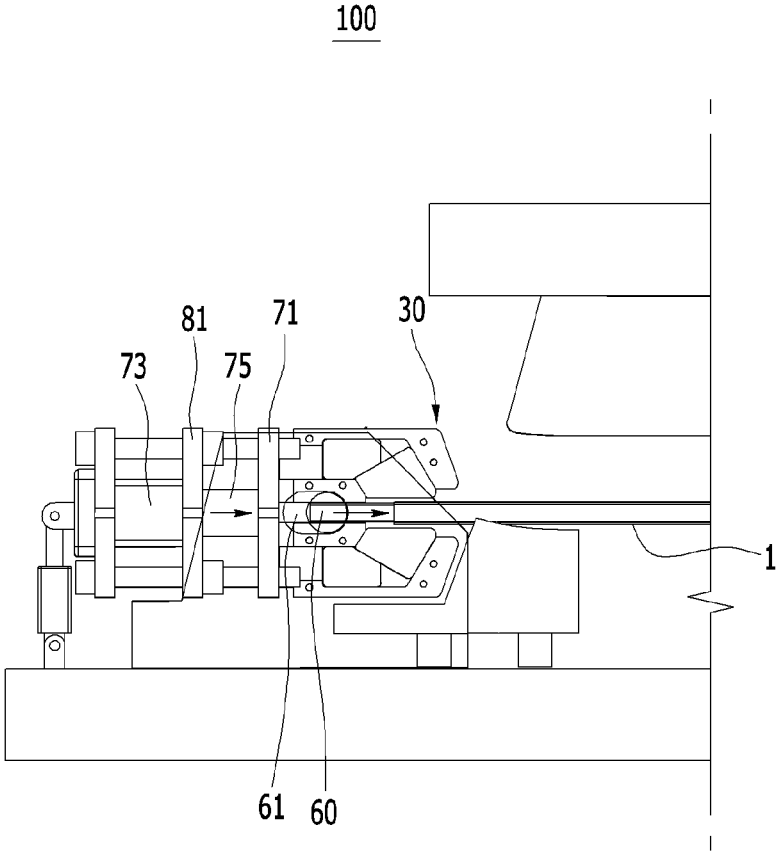

Then, as shown in FIG. 8, the clamping cylinder 73 is operated. Thus, the operating rod 75 of the clamping cylinder 73 pushes the pressing plate 71 toward the clamping holder 30.

Since the pressing plate 71 is connected with the core rod 61 of the core member 60, the core member 60 moves while being guided by the third guide portion 36 (referring to FIG. 5) of the clamping holder 30 along the horizontal direction so as to be inserted into the pipe 1.

Figure 9:
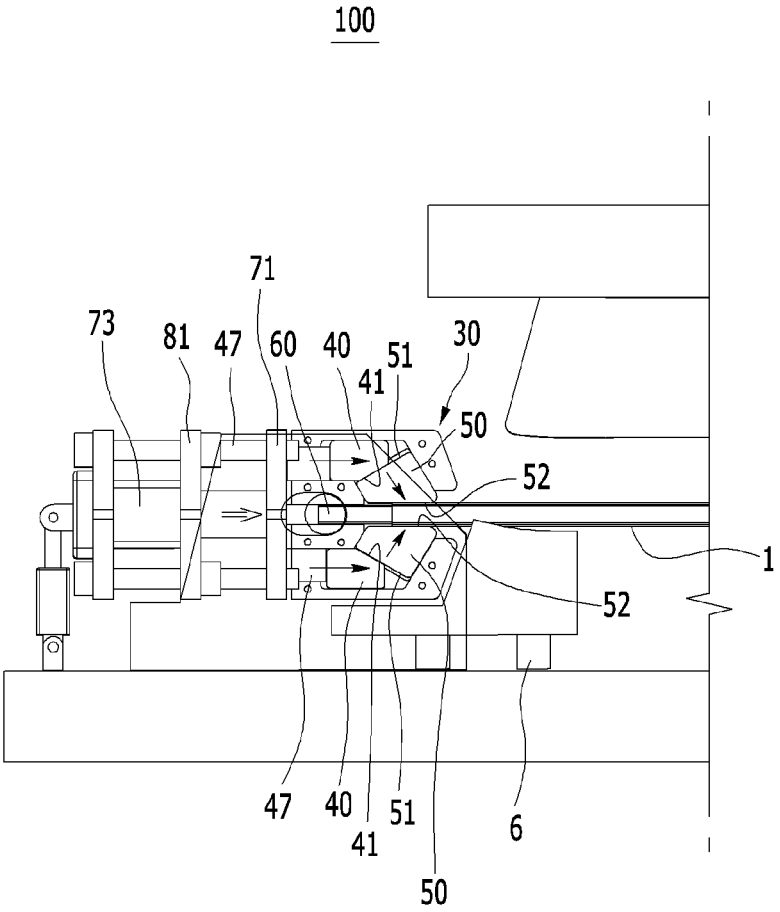

Simultaneously, the pressing plate 71, as shown in FIG. 9, pushes the cam rods 47 of the upper and lower cam blocks 40.

Then the upper and lower cam blocks 40 are guided by the first guide portion of the clamping holder 30 along the horizontal direction.

Since the cam slant surfaces 41 of the upper and lower cam blocks 40 contact the slip slant surfaces 51 of the upper and lower clamping blocks 50, the upper and lower cam blocks 40 slip along the slip slant surface 51 and push the upper and lower clamping blocks 50.

By pressing of the upper and lower cam blocks 40, the upper and lower clamping blocks 50 slide along the second guide portion 34 of the clamping holder 30.

Therefore, the upper and lower clamping blocks 50 clamp the end portions of the pipe 1 using the clamping surface 52. The end portions of the pipe 1 may be clamped strongly by the clamping protrusion 53 of the clamping surface 52.

Since the core member 60 is inserted into the end portions of the pipe 1, the end portions of the pipe 1 may not be crushed despite clamping of the upper and lower clamping blocks 50.

Figure 10:
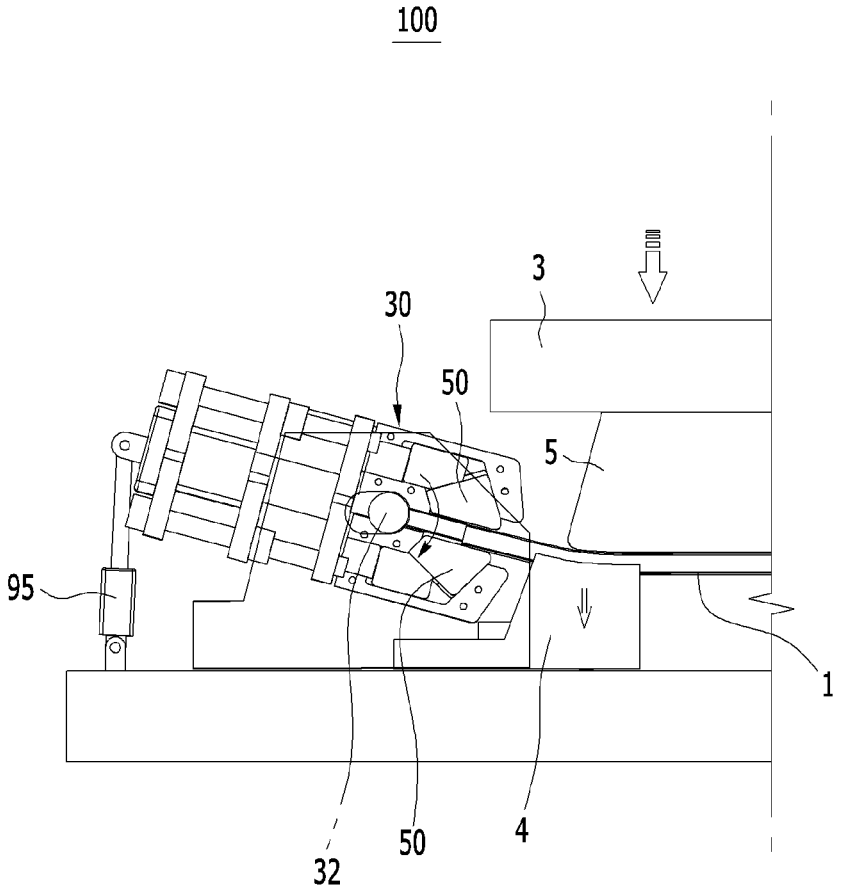

Then, as shown in FIG. 10, the upper die 5 moves downward by the operation of the slider 3 to the lower die 4 so as to press the end portions of the pipe 1. The lower die 4 then moves downward while overcoming supporting force of the cushion pin 6.

At a state of clamping the end portions of the pipe 1 by the upper and lower clamping blocks 50, the end portions of the pipe 1 are plastically deformed on the curvature forming surface 7 of the lower die 4 to have a predetermined curvature.

The clamping holder 30 clamping the end portions of the pipe 1 using the upper and lower clamping blocks 50 rotates around the rotation shaft 32 when the upper die 5 and the lower die 4 plastically deform the end portions of the pipe 1.

The support cylinder 95 stably supports the rotation of the clamping holder 30. The clamping holder 30 rotates around the rotation shaft 32 to allow the pipe 1 to be bent at a predetermined angle when the lower die 4 and the upper die 5 press the pipe 1.

Figure 11:
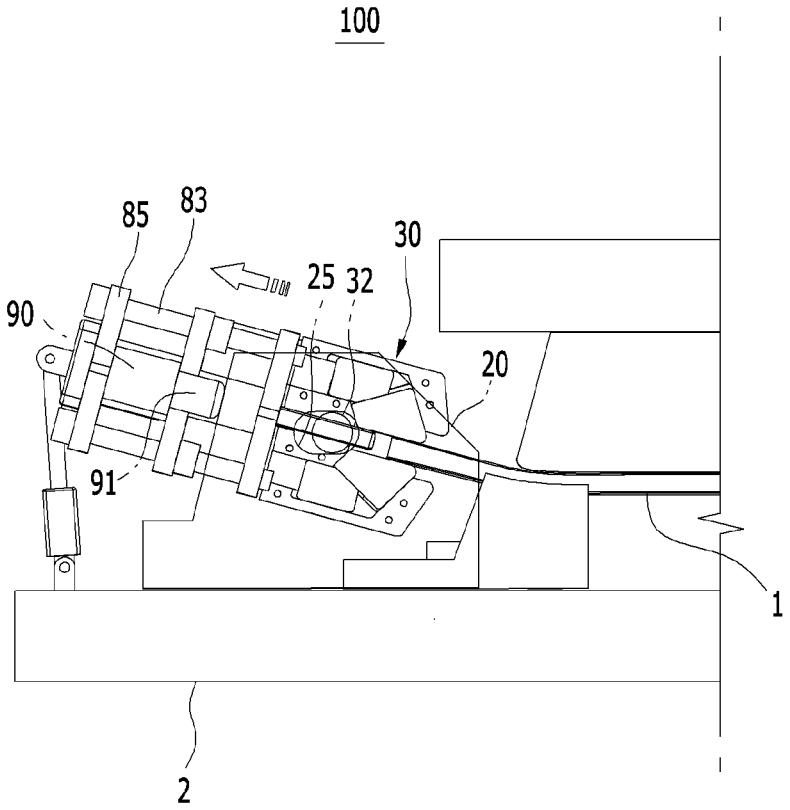

As shown in FIG. 11, the stretch cylinder 90 is then operated to push the clamping die 20 using the operating rod 91.

In a state in which the upper and lower clamping blocks 50 clamp the pipe 1, the stretch cylinder 90 pushes the die main body 23 of the clamping die 20 using the operating rod 91, so the clamping holder 30 moves in the outward direction of the pipe 1 with the supporting plate 85, the fixing rod 83, and so on.

Since the operating rod 91 of the stretch cylinder 90 pushes the die main body 23, the clamping holder 30 moves along the slot 25 of the die main body 33.

The upper and lower clamping blocks 50 therefore pull the end portions of the pipe 1, inducing stretching. By inducing the pipe 1 to be plastically formed, spring-back may be prevented and manufacturing precision may be improved.

Figure 12:
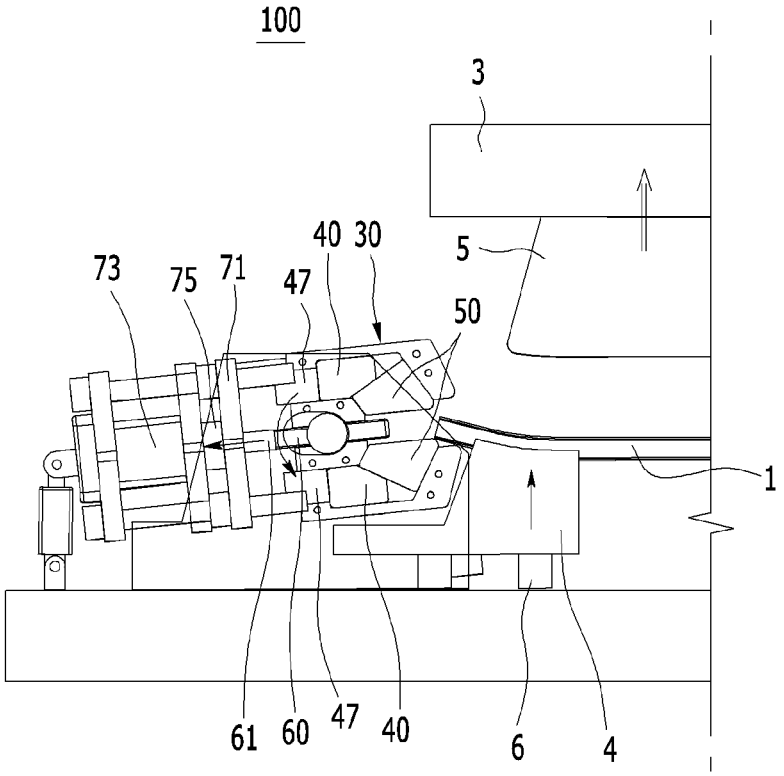

After stretching the pipe, as shown in FIG. 12, the clamping cylinder 73 is operated rearward. Then the operating rod 75 is positioned at an initial position by the operation of the clamping cylinder 73, and the pressing plate 71 moves in the opposite direction of the clamping holder 30.

Since the pressing plate 71 is connected with the core rod 61 of the core member 60, the core member 60 is moved while being guided by the third guide portion 36 along the horizontal direction and separated from the pipe 1.

After that, the pressing plate 71 is moved by the operation of the clamping cylinder 73 and releases pressing of the cam rods 47 of the upper and lower cam blocks 40.

Simultaneously, the clamping to the pipe 1 by the upper and lower clamping blocks 50 is released.

Then the upper die 5 is separated from the lower die 4 by the operation of the slider 3. The lower die 4 is then positioned at the initial position by the cushion of the cushion pin 6, and simultaneously, the clamping holder 30 rotates in the opposite direction by the restoring force of the lower die 4 transmitted through the pipe 1 so that the pipe 1 may be separated from the upper and lower clamping blocks 50.

As described above, the pipe 1 may be plastically formed to have a predetermined curvature in a state in which both ends of the pipe 1 are clamped and the clamping holder 30 rotates.

According to an exemplary embodiment of the present invention, since a stretching process may be realized after bending end portions of the pipe 1 so as to induce the pipe 1 to be formed plastically, spring-back may be prevented and manufacturing precision may be improved.

In addition, according to an exemplary embodiment of the present invention, a relatively low investment is required, a manufacturing cycle may be reduced, and productivity may be improved.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A clamping device for a bending press, comprising:

a clamping die with a space formed therein;

a clamping holder rotatably disposed within the space of the clamping die around a rotation shaft which is a part of the clamping holder;

an upper cam block and a lower cam block respectively disposed within the clamping holder and slidable along a horizontal direction, the upper cam block and the lower cam block respectively have a cam slant surface formed at a front side of the upper cam block and the lower cam block;

an upper clamping block and a lower clamping block respectively having a slip slant surface which is slantedly formed for contacting the cam slant surface and on which the upper cam block and the lower cam block slide, and the upper clamping block and the lower clamping block directly clamping an end of a pipe disposed therebetween by sliding along a slant direction of the clamping holder; and a pressing unit configured to press the upper cam block and the lower cam block.

2. The clamping device of claim 1, wherein the clamping device further comprises a core member which is slidably disposed between the upper clamping block and the lower clamping block and selectively inserted into the pipe by pressing of the pressing unit.

3. The clamping device of claim 2, wherein the clamping holder comprises:

a first guide portion guiding each of the upper cam block and the lower cam block in the horizontal direction;

a second guide portion guiding the upper clamping block and the lower clamping block to move the upper clamping block and the lower clamping block close to each other; and a third guide portion formed between the first guide portions and guiding the core member along the horizontal direction.

4. The clamping device of claim 2, wherein the core member has a core rod connected to the pressing unit.

5. The clamping device of claim 1, wherein the upper cam block and the lower cam block respectively have a cam rod protruded toward the pressing unit.

6. The clamping device of claim 2, wherein the pressing unit comprises:

a pressing plate which is movably disposed on a plurality of guide bars fixed to the clamping holder and configured to push the upper cam block, the lower cam block and the core member; and a clamping cylinder which pushes the pressing plate though an operating rod for the pressing plate to be moved.

7. The clamping device of claim 6, wherein the clamping device further comprises a fixing plate fixed to the plurality of guide bars, wherein the operating rod of the clamping cylinder is connected to the pressing plate through the fixing plate.

8. The clamping device of claim 7, wherein:

a plurality of fixing rods are mounted to the fixing plate at an opposite side to the plurality of guide bars ;

a supporting plate is mounted to the fixing rod; and the clamping cylinder is mounted to the supporting plate.

9. The clamping device of claim 8, wherein:

a mounting plate is mounted to the supporting plate; and a stretch cylinder, which selectively pushes the clamping die, is mounted to the mounting plate.

10. The clamping device of claim 9, wherein:

a slot into which the rotation shaft is inserted is formed to the clamping die; and the clamping holder moves along the slot by pressing of the stretch cylinder.

11. The clamping device of claim 1, wherein the upper clamping block and the lower clamping block respectively have a plurality of clamping protrusions disposed at an end portion of the upper clamping block and the lower clamping block for clamping the pipe.

12. The clamping device of claim 1, wherein the upper clamping block and the lower clamping block respectively have a scratched surface disposed at an end portion of the upper clamping block and the lower clamping block for clamping the pipe.

13. A bending press system comprising:

a lower die which is disposed on a base through a cushion pin and movable up and down through the cushion pin, the lower die has a curvature forming surface at an upper side for forming a curvature to a pipe which is mounted on the lower die;

an upper die disposed above the base and movable up and down;

a clamping die fixed on the base and having a space formed within the clamping die;

a clamping holder rotatably disposed within the space of the clamping die around a rotation shaft which is a part of the clamping holder;

an upper cam block and a lower cam block respectively disposed within the clamping holder and slidable along a horizontal direction, the upper cam block and the lower cam block respectively have a cam slant surface formed at a front side of the upper cam block and the lower cam block respectively;

an upper clamping block and a lower clamping block respectively having a slip slant surface which is slantedly formed for contacting the cam slant surface and on which the upper cam block and the lower cam block slide, and the upper clamping block and the lower clamping block directly clamping an end of the pipe disposed therebetween by sliding along a slant direction of the clamping holder; and a pressing unit pressing the upper cam block and the lower cam block.

14. The bending press system of claim 13, wherein the clamping device further comprises a core member which is slidably disposed between the upper clamping block and the lower clamping block and selectively inserted into the pipe by pressing of the pressing unit.

15. The bending press system of claim 14, wherein the clamping holder comprises:

a first guide portion guiding each of the upper cam block and the lower cam block along the horizontal direction;

a second guide portion guiding the upper clamping block and the lower clamping block to move the upper clamping block and the lower clamping block close to each other; and a third guide portion formed between the first guide portions and guiding the core member along the horizontal direction.

16. The bending press system of claim 14, wherein the pressing unit comprises:

a pressing plate which is movably disposed on a plurality of guide bars fixed to the clamping holder and configured to push the upper cam block, the lower cam block and the core member; and a clamping cylinder which pushes the pressing plate though an operating rod for the pressing plate to be moved.

17. The bending press system of claim 16, wherein the clamping device further comprises a fixing plate fixed to the plurality of guide bars, wherein the operating rod of the clamping cylinder is connected to the pressing plate through the fixing plate, a plurality of fixing rods are mounted to the fixing plate at an opposite side to the plurality of guide bars, a supporting plate is mounted to the fixing rod, and the clamping cylinder is mounted to the supporting plate.

18. The bending press system of claim 17, wherein:

a mounting plate is mounted to the supporting plate;

a stretch cylinder, which selectively pushes the clamping die, is mounted to the mounting plate;

a slot into which the rotation shaft is inserted is formed to the clamping die; and the clamping holder moves along the slot by pressing of the stretch cylinder.

19. The bending press system of claim 18, wherein a support cylinder is hingedly connected with the base and the mounting plate for supporting rotation of the clamping holder.

* * * * *